US006990777B2

(12) United States Patent
Poliacek et al.

(10) Patent No.: US 6,990,777 B2
(45) Date of Patent: Jan. 31, 2006

(54) TILE INSTALLATION SYSTEM

(76) Inventors: Jiri Poliacek, 5339 W. 139th St., Hawthorne, CA (US) 90250; Jirina Jordan, 5339 W. 139th St., Hawthorne, CA (US) 90250

( * ) Notice: Subject to any disclaimer, the term of this patent is extended or adjusted under 35 U.S.C. 154(b) by 0 days.

(21) Appl. No.: 10/428,319

(22) Filed: Apr. 29, 2003

(65) Prior Publication Data

US 2004/0216420 A1 Nov. 4, 2004

(51) Int. Cl.
*E04F 15/00* (2006.01)
*E04F 13/08* (2006.01)

(52) U.S. Cl. ..... 52/384; 52/385; 52/480; 52/387; 52/506.08; 52/747.11; 52/302.1; 52/780

(58) Field of Classification Search ..... 52/384, 52/385, 747.11, 263, 311.2, 456, 480, 762, 52/764, 780, 506.07, 506.08, 508, 510, 387, 52/302.1, 666, 667
See application file for complete search history.

(56) References Cited

U.S. PATENT DOCUMENTS 754,888 A * 3/1904 Pease ..... 52/766
764,948 A * 7/1904 Krebs ..... 52/464
1,818,014 A * 8/1931 Snaman ..... 52/686
2,030,556 A * 2/1936 Veltung ..... 52/318
2,199,244 A * 4/1940 Mulford ..... 52/307
2,668,991 A * 2/1954 Taphoureau ..... 52/592.1
2,852,932 A * 9/1958 Cable ..... 52/385
3,089,570 A * 5/1963 O'Neil, Jr. ..... 52/713
3,298,153 A * 1/1967 Rolland ..... 52/663
3,425,179 A * 2/1969 Haroldson ..... 52/283
3,504,472 A * 4/1970 Clement ..... 52/477
3,520,095 A * 7/1970 Jonason et al. ..... 52/387
3,785,110 A * 1/1974 Galloway et al. ..... 52/715
3,918,222 A * 11/1975 Bahramian ..... 52/223.7
4,135,338 A * 1/1979 Malavasi ..... 52/387
4,233,792 A * 11/1980 Malavasi ..... 52/387
4,281,498 A * 8/1981 Kern ..... 52/780

(Continued)

FOREIGN PATENT DOCUMENTS

CH 681644 A5 * 4/1993

(Continued)

*Primary Examiner*—Robert Canfield
(74) *Attorney, Agent, or Firm*—Cislo & Thomas LLP

(57) ABSTRACT

A lattice of support surfaces are used to support substantially the perimeter of a construction tile. The support surface is made integral with a decorative border. Linear railways attach orthogonally to other railways to form the lattice. Tiles are set into the lattice providing a warmer installation relative to installation over concrete tile foundation.

23 Claims, 11 Drawing Sheets

U.S. PATENT DOCUMENTS 4,361,614 A * 11/1982 Moffitt, Jr. ..... 428/138
4,454,700 A * 6/1984 Kern ..... 52/665
4,468,910 A * 9/1984 Morrison ..... 52/591.2
4,628,645 A * 12/1986 Tafelski, Jr. ..... 52/169.1
4,674,254 A * 6/1987 Koehler et al. ..... 52/506.06
4,744,194 A * 5/1988 Yasuyoshi ..... 52/747.11
4,773,200 A * 9/1988 Young ..... 52/506.06
5,003,744 A * 4/1991 Taylor ..... 52/308
5,102,256 A * 4/1992 Gosnell ..... 404/40
5,323,575 A * 6/1994 Yeh ..... 52/177
5,418,036 A * 5/1995 Tokikawa et al. ..... 428/120
5,465,546 A * 11/1995 Buse ..... 52/480
5,469,681 A * 11/1995 Wu ..... 52/656.9
5,471,807 A * 12/1995 Vasquez ..... 52/553
5,619,833 A * 4/1997 Neff ..... 52/506.07
5,640,821 A * 6/1997 Koch ..... 52/698
6,065,264 A * 5/2000 Imler et al. ..... 52/589.1
6,395,362 B1 * 5/2002 Pacione ..... 428/45
6,647,684 B1 * 11/2003 Gank ..... 52/385
2002/0069611 A1 * 6/2002 Leopolder ..... 52/748.1
2003/0097808 A1 * 5/2003 Sabatini ..... 52/384

FOREIGN PATENT DOCUMENTS

DE 40 06 358 A1 * 9/1991
GB 2 200 930 A * 8/1988

* cited by examiner

TILE INSTALLATION SYSTEM

FIELD OF THE INVENTION

This invention relates generally to tile and masonry installation; and specifically to a method and framework for installing tiles.

BACKGROUND OF THE INVENTION

The building industry has long used various types of tiles in construction projects. Tiles come in many forms and are manufactured from various types of materials, in a wide variety of colors and surface textures. For example, ceramic tile is often used in bathroom applications. Marble tile is often used for flooring and other decorative applications.

Better techniques for installation of tiles have evolved over time. In fact, many patents that describe installation techniques have been granted. Most of these evolutions in tile installation techniques have been developed in response to the inadequacy of former installation methods. One common problem with installation of any tile is the fact that individual tiles need to be aligned relative one to another. In response to this problem, prior art methods for installation of tile include methods where spacers are introducing between individual tiles in order to ensure uniform tile installation. In fact, all of the known art addresses this major problem. Various techniques for the installation of tile spacers have been devised including the use of a pre-fabricated lattice that can be placed on an installation surface. Once the pre-fabricated lattice is installed, individual tiles may be secured into the lattice resulting in a clean, uniform installation. Of course, all of these prior art methods require the use of a mortar in order to secure an individual tile to the installation surface. Additional mortar (i.e. "grout") is then used to fill the interspatial gap in between individual tiles.

These prior art methods fail to address some other major problems associated with the installation of tile in typical construction applications. One such problem is the need to easily replace an individual tile if it where to be inadvertently damaged. Yet another problem is that all known tile installation techniques apply an individual tile to a installation surface that is, in many cases, a cold concrete slab. Hence, a tile floor constructed according to conventional wisdom results in a cold, heat-sunk surface.

SUMMARY OF THE INVENTION

The present invention comprises a method for installing tiles that results in much warmer floor when compared to tile floors constructed according to prior art techniques. According to one example method, a support is provided substantially around the outer perimeter of a tile. This support is typically provided within the footprint of the tile. According to this method, a border is also provided around the tile. This border eliminates the need for tile grout. According to the method, the support holds the tile up off of an installation surface (e.g. a concrete slab). Because the tile is supported off from the installation surface, it is easily replaced in the event of damage. Also, heat is retained by the tile because it does not come in contact with the installation surface. This results in a "warmer" tile floor.

According to one variation of the present method, a support may be provided for a tile by placing a first railing that has a first end. A second railing may be attached orthogonally to the first railing. The position of the second railing is adjusted along the length of the first railing so as to accommodate a tile of a particular dimension. According to yet another alternative method, a third railing is also orthogonally attached to the first railing. The position of the third railing relative to the second railing is then adjusted to accommodate a tile of a particular dimension. According to yet another variation of the present method, the second railing may be attached to the first railing by mating a slide bushing on the second railing with a linear trackway on the first railing.

In one variation of the present method, support proximate to the outer perimeter of the tile is provided by a ledge along the first railing. According to yet another variation of the present method, a border may be provided by providing a raised surface along the first railing that is an opposition to a support ledge. According to yet another variation of the present method, drainage is provided across the border and the support. Yet another variation of this method, airflow is provided across the border and the support.

The present invention further comprises a an alternative method for installing tiles the comprises the provision of a plurality of railings each having end connectors and the provision of a plurality of railing ties each of which has at least two railing connectors. The railings, according to this alternative method, a been attached to the railing ties in order to form a receptacle. Tiles may then be installed in the receptacle.

The present invention further comprises a tile installation fixture. According to one embodiment of the invention, a tile installation fixture comprises a linear support having top and bottom surfaces and a border also having top and bottom surfaces. The border is a collinear with the linear support. According to one alternative example embodiment of the invention, the tile installation picture further comprises a linear attachment trackway disposed in a collinear manner to the linear support. According to one illustrative embodiment of invention, the linear attachment trackway is formed by a notch that is set collinearly in the top surface of the linear support. According to yet another alternative embodiment of the invention, the tile installation picture further comprises the orifice that leads for the top surface to the bottom surface of the linear support. This orifice may serve as a drainage for any moisture that may collect at the surface of the linear support or in any notch that may form a linear trackway is said linear support.

According to one alternative embodiment of the invention, the tile installation fixture further comprises a slide bushing data substantially perpendicular to the linear support. Generally, this slide bushing is disposed at one end of the tile installation fixture in may be embodied as a finger set orthogonal to the linear support and oriented downward from the top surface of the border. According to yet another alternative embodiment of the invention, the tile installation fixture further comprises an airflow pathway that is notch into the bottom surfaces of the linear support and the border. This pathway is set orthogonal to the linear support.

The present invention further comprises a tile installation railing tie. Such tile installation railing tie comprises at least two railing connectors and a border disposed between said two railing connectors. Generally, railing ties may be used to hold railings together to form a receptacle capable of receiving a tile.

BRIEF DESCRIPTION OF THE DRAWINGS

The foregoing aspects are better understood from the following detailed description of one embodiment of the invention with reference to the drawings, in which.

DETAILED DESCRIPTION OF THE INVENTION

Figure 1:
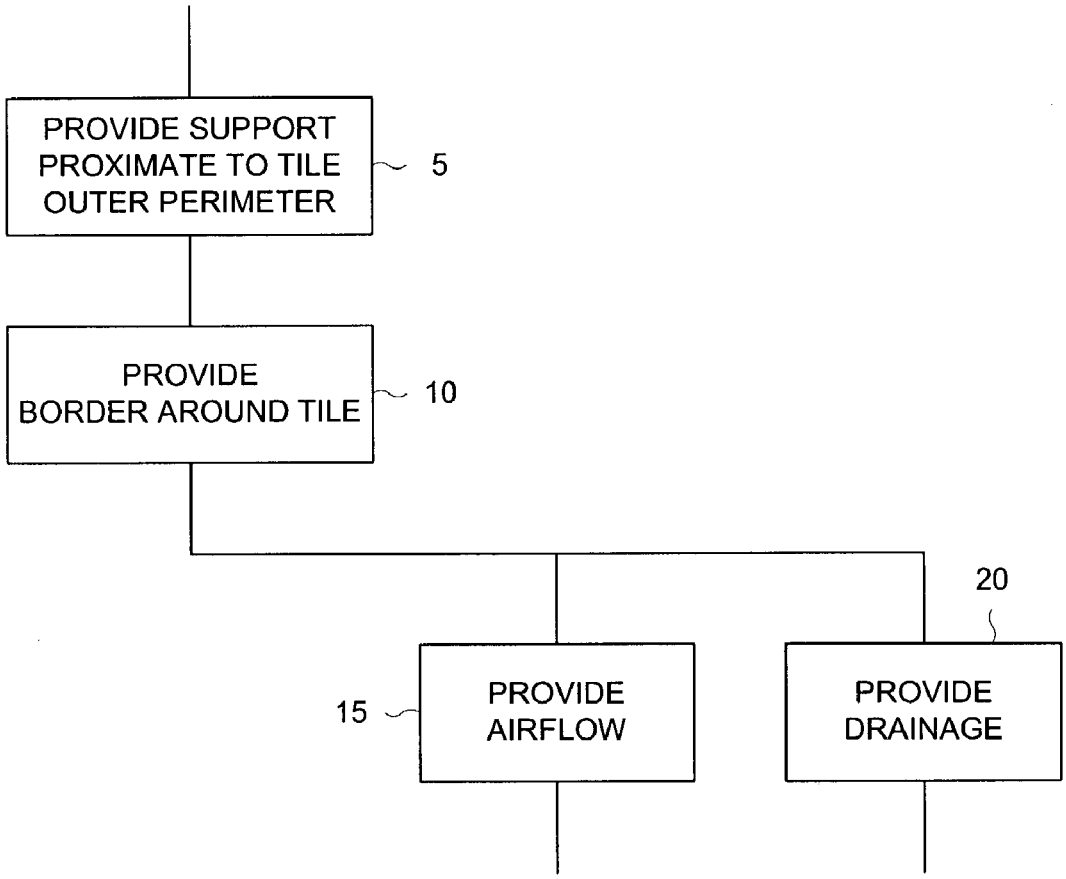
FIG. 1 is a flow diagrams that depicts one example method for installing tiles according to the present invention.

FIG. 1 is a flow diagrams that depicts one example method for installing tiles according to the present invention. According to this example method, tiles may be installed in a lattice of receptacles wherein each receptacle is formed by providing a support proximate to the outer perimeter of the tile (step 5). Each of said tiles typically have a top and bottom surface and an outer perimeter. According to one example embodiment, the support is provided within the footprint of the tile. According to this method, a border is provided around the tile (step 10). This border may be of any width and typically eliminates the need for tile grout. The support generally provides an offset for an installed tile and prevents the bottom surface of the tile from contacting a substrate (e.g. a concrete slab). Hence, the support is generally disposed in between the bottom surface of the tile and an installation substrate. Since the tile is not adhered to the installation substrate, it may be easily removed in the event that an individual tile is damaged through either ordinary or extraordinary use. According to one alternative method, adhesive may be introduced between the top surface of the support and the bottom of the tile placed thereon. This precludes inadvertent movement of the tile or accidental discharge from the receptacle.

According to one variation of this method, airflow is provided between receptacles by providing an airflow pathway across the support and the border (step 15). According to yet another variation of this method, a drainage path is provided through the support (step 20). This drainage path allows moisture that may accumulate at the top surface of the support to drain downward.

Figure 2:
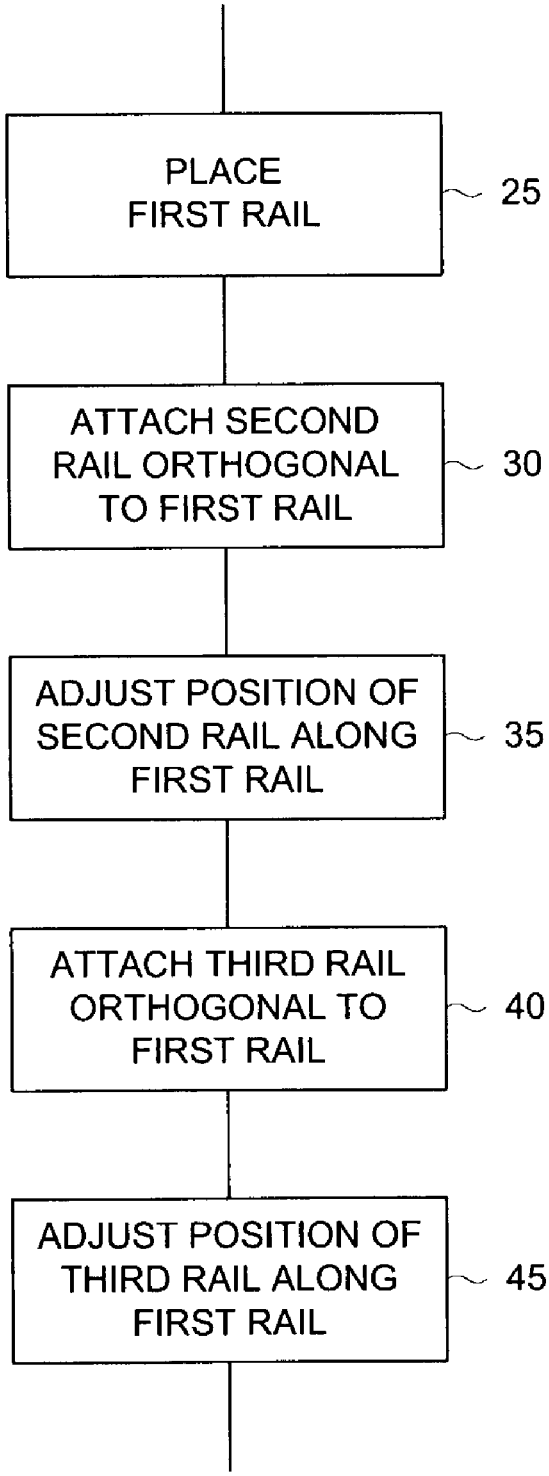
FIG. 2 is a flow diagram that depicts one alternative example method for providing a support proximate to the outer perimeter of a tile.

FIG. 2 is a flow diagram that depicts one alternative example method for providing a support proximate to the outer perimeter of a tile. According to this alternative method, a support is provided by placing a first rail (step 25) onto an installation substrate. A second rail is orthogonally attached to the first rail (step 30). The position of the second rail along the first rail is then adjusted. This may be accomplished in order to accommodate a tile of a particular dimension. According to one alternative variation of this illustrative method, a third rail is orthogonally attached to the first rail (step 40). The position of the third rail along the first rail is then adjusted to accommodate a tile of a particular dimension (step 45).

According to one variation of this illustrative method, attachment of the second railing to the first railing may be a cottage by mating a slide bushing on the second railing with a linear trackway on the first railing. According to yet another variation of this illustrative method, a support proximate to be outer brother of the tile may be provided by means of a ledge running along the first rail. According to yet another variation of this method, a border may be provided by means of a raised surface that also runs along the railing alongside the ledge comprising the support.

Figure 3:
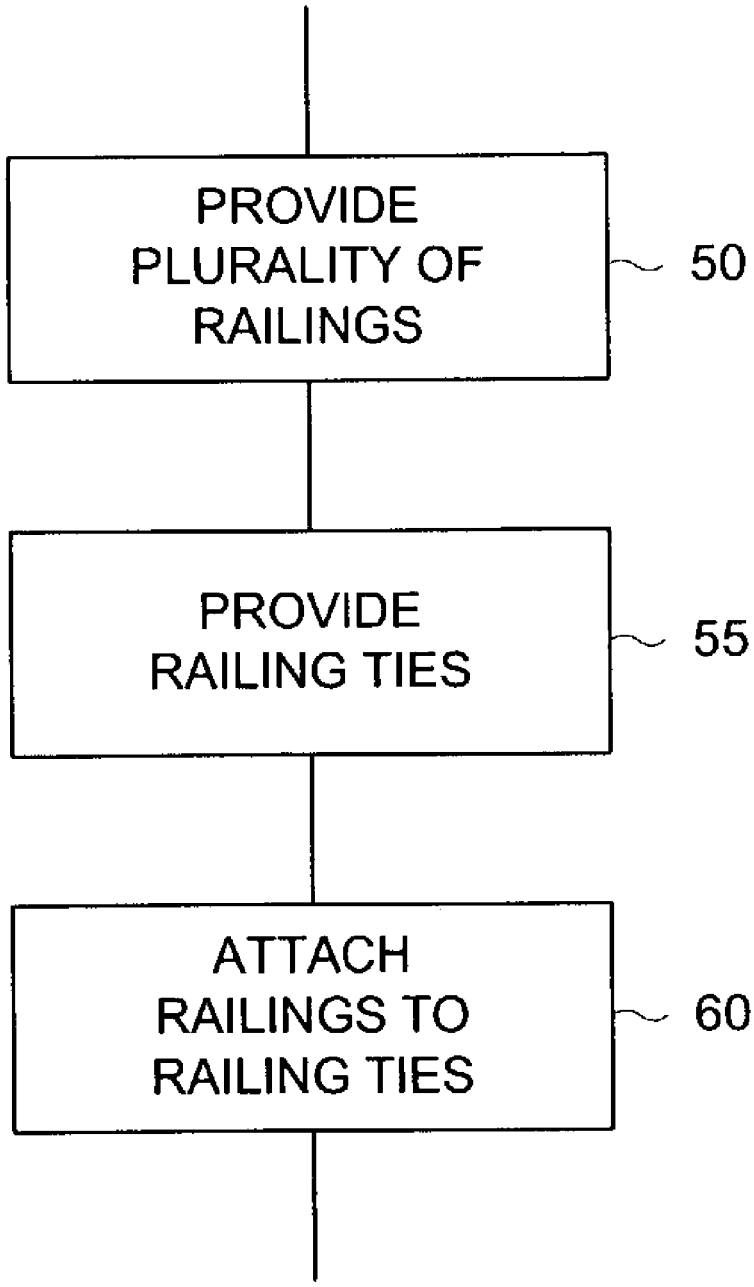
FIG. 3 is a flow diagram that depicts one alternative method for installing tiles.

FIG. 3 is a flow diagram that depicts one alternative method for installing tiles. According to this example method, a lattice of tile receptacles is established by providing a plurality of railings (step 50) and a plurality of railing ties (step 55). The railings are then attached to the railing ties to form a lattice (step 60). Individual tiles may then be installed into resulting lattice of tile receptacles.

Figure 4:
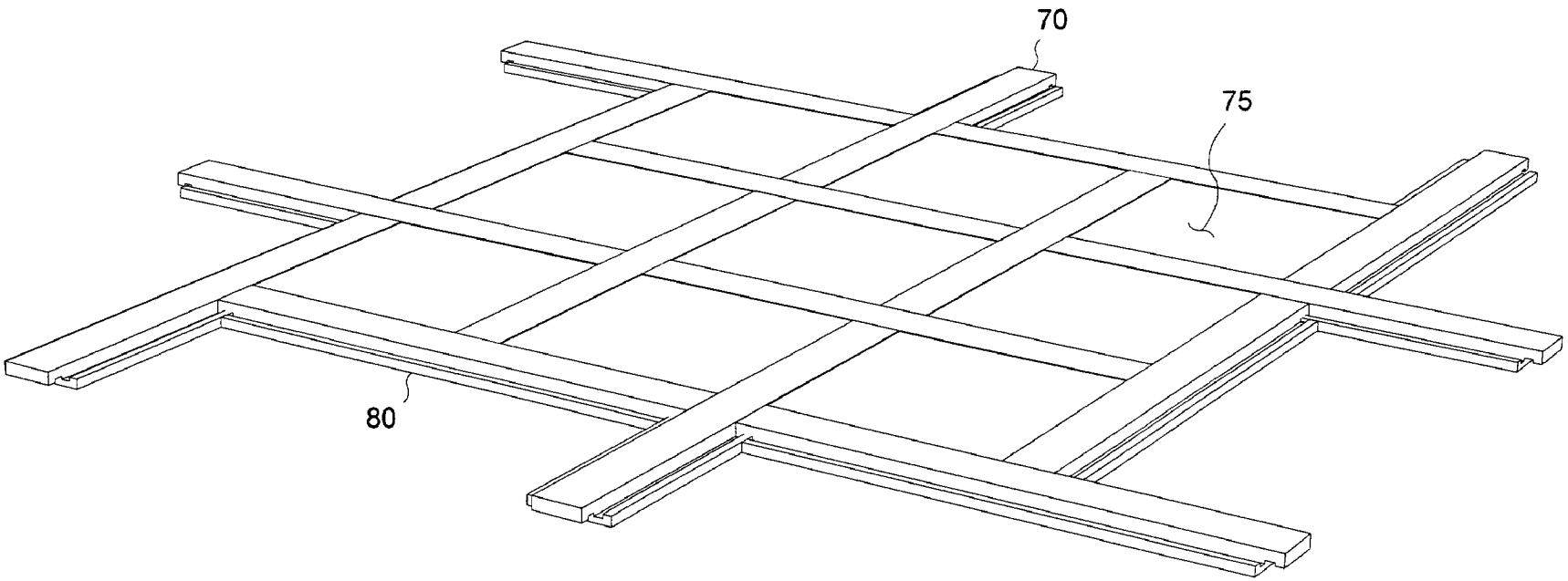
FIG. 4 is a pictorial diagram that illustrates the installation of tiles in a lattice of tile receptacles according to the present invention.

FIG. 4 is a pictorial diagram that illustrates the installation of tiles in a lattice of tile receptacles according to the present invention. Railings 70, which are also known as tile installation fixtures, are attached to other railings to form receptacles capable of receiving a tile 75. According to this exemplary embodiment, the railings form a herringbone pattern where one railing 80 is orthogonally attached approximately mid-span to an adjoining railing 70.

Figure 5:
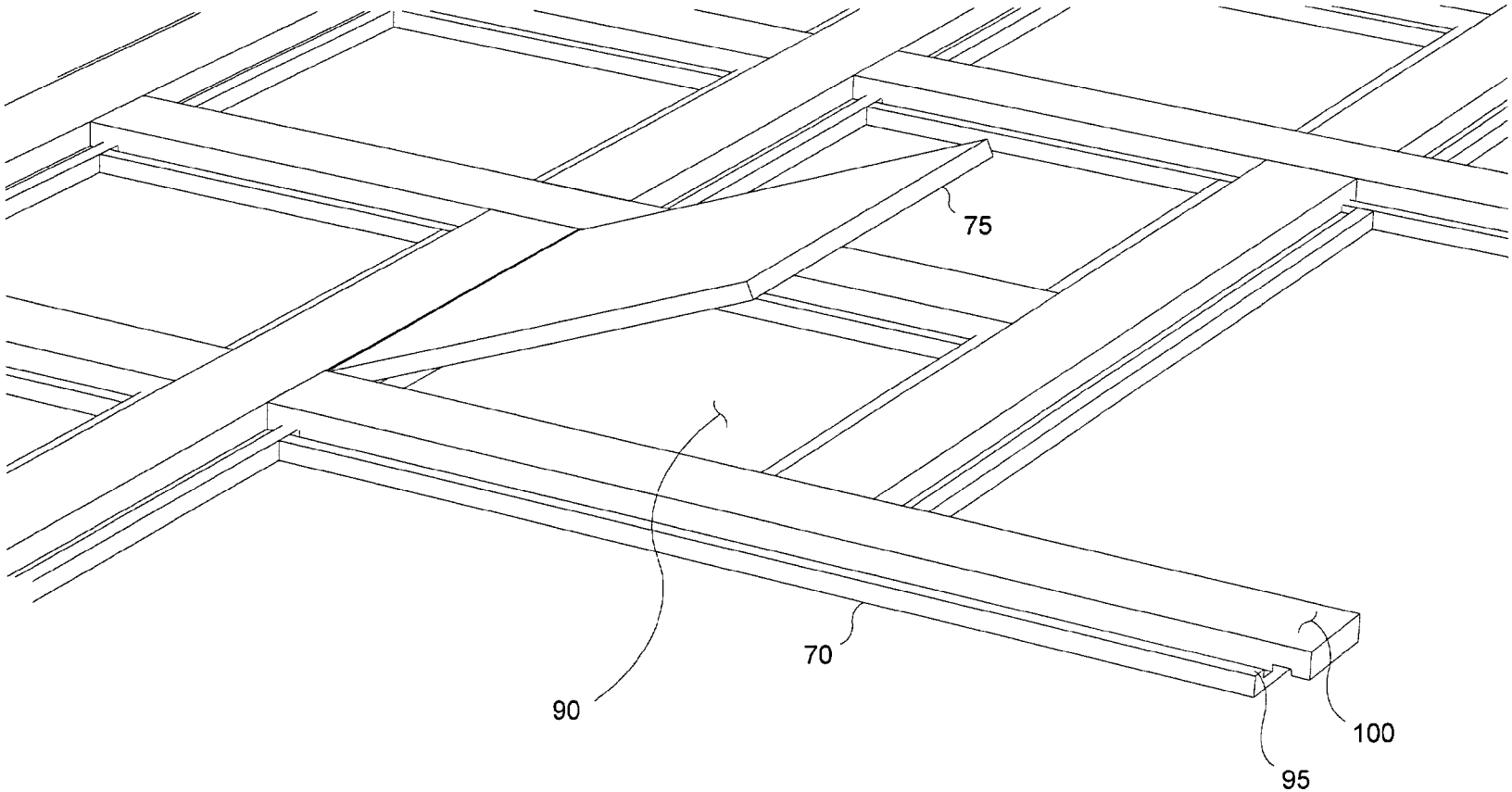
FIG. 5 is a pictorial diagram that illustrates the installation of a tile into a receptacle according to method of the present invention.
Figure 6:
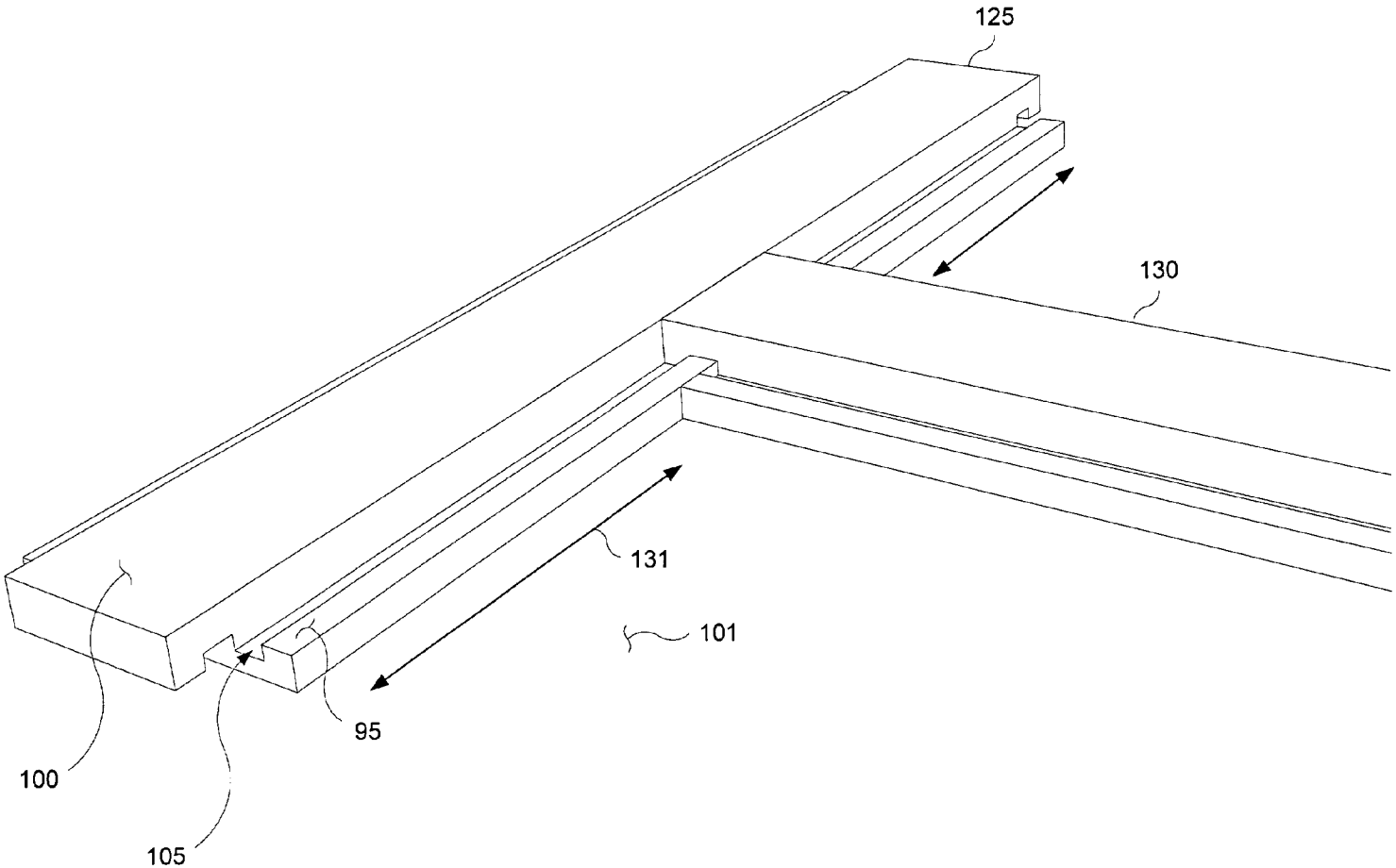
FIGS. 6 through 9 are pictorial diagrams that illustrate one example embodiment of an attachment means for orthogonally attaching one railing to another according to the present invention.
Figure 7:
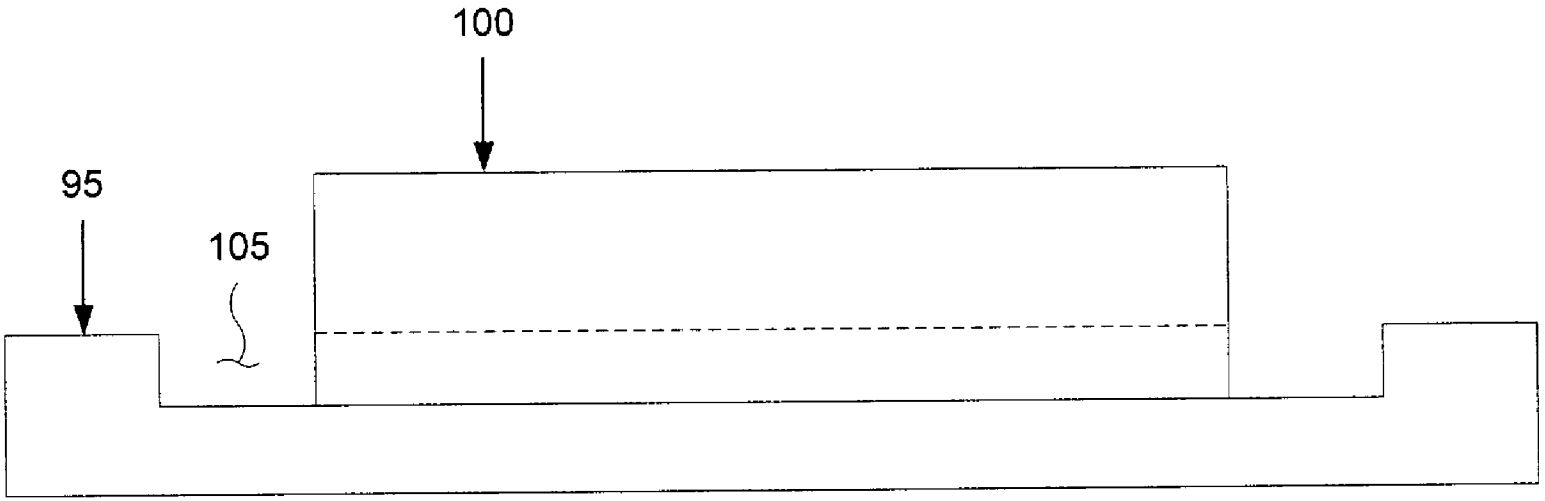
Figure 8:
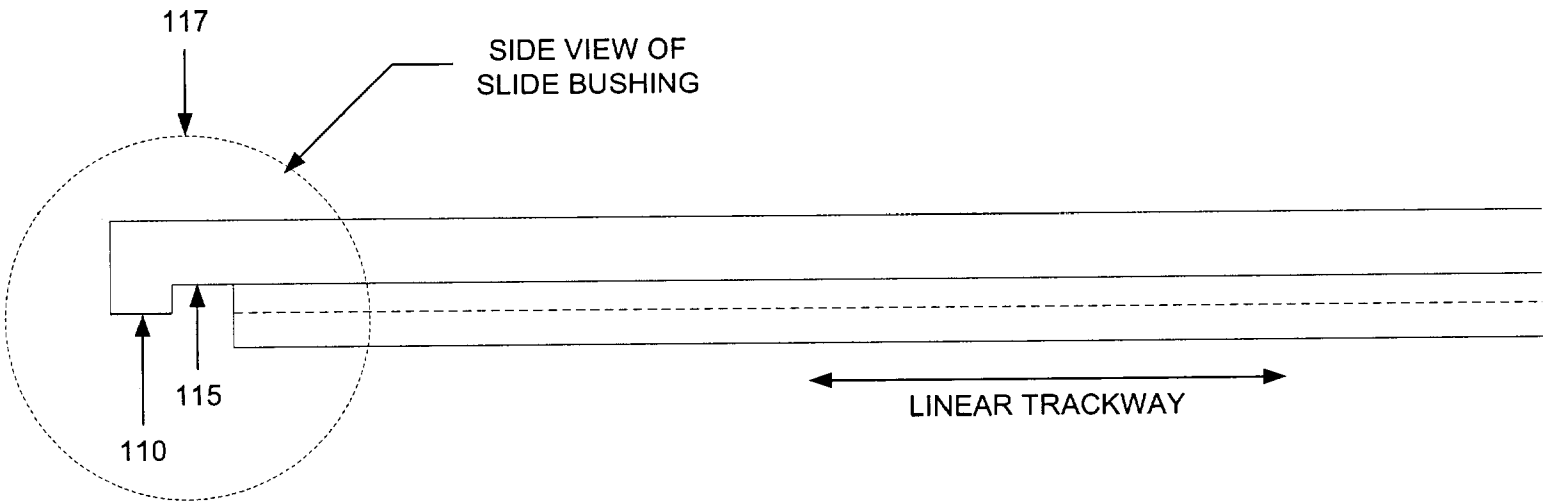

FIG. 5 is a pictorial diagram that illustrates the installation of a tile into a receptacle according to method of the present invention. According to this example embodiment, a tile 75 is installed into a receptacle 90. The receptacle 90 is generally formed by railings 70 substantially about the outer perimeter of the tile 75. Note that the railings typically comprise a tile support 95 and a border 100.

FIGS. 6 through 9 are pictorial diagrams that illustrate one exemplary embodiment of an attachment means for orthogonally attaching one railing to another according to the present invention. According to one exemplary embodiment of the present invention, a first tile installation fixture 125 comprises a tile support 95 and a border 100. Generally, both the tile support 95 and the border 100 have top and bottom surfaces. According to this exemplary embodiment, the tile installation fixture 125 may be installed on a substrate 101 wherein the bottom surface of both the tile support 95 and the border 100 contact the substrate 101.

The tile support 95 is set colinear with the border 100. The top surface of the tile support 95 is at lower elevation relative to the top surface of the border 100. The difference in the elevation between the top surface of the border 100 and the linear support 95 is typically set to the thickness of a particular tile. Hence, once a tile is positioned on the tile support 95, the top surface of the tile will finish substantially flush with the top surface of the border 100.

First tile installation fixture 125 is typically placed onto the substrate 101 and a second tile installation fixture 130 is then attached orthogonally to the first fixture 125. According to one exemplary embodiment of the present invention, the orthogonal attachment is accomplished by means of a linear attachment trackway. Hence, according to this exemplary embodiment of the present invention, the first fixture 125 comprises a linear attachment trackway 105. According to one alternative exemplary embodiment, the linear attachment trackway 105 comprises a notch colinearly disposed into the top surface of the tile support 95.

According to this exemplary embodiment, the second rail 130 comprises a slide bushing 117 (FIG. 8) oriented substantially perpendicular to the tile support 95. The slide bushing 117 (FIG. 8), according to one alternative embodiment of the invention, comprises a finger that protrudes downward from the top surface of the border of second rail 130. As depicted in the figure, the bottom surface of the border is itself partially notched at the end of the tile installation fixture in order to form the finger 110. According to yet another exemplary embodiment, the slide bushing further comprises a carrier slot 115 that is also formed by a deeper notch into the bottom surface of the border. This carrier slot 115 is disposed in between the finger 110 and the main body of the border of second rail 130. It is important to note that the finger and the carrier slot are typically sized according to a corresponding linear trackway 105, which, according to one embodiment, comprises a notch in the tile support 95.

Figure 9:
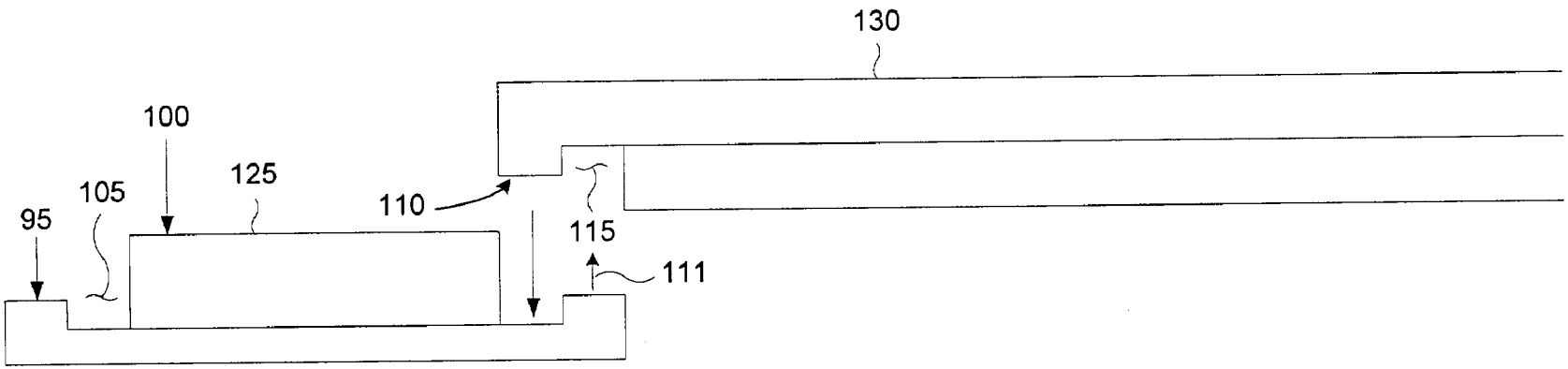

In application, the finger 110 and the carrier slot 115 that form the slide bushing 117 disposed at the end of second railing 130 interlock 111 (as shown in FIG. 9) with the linear trackway 105 of first railing 125. Those skilled in the art will recognize that any suitable linear trackway and slide bushing structure may be utilized in order to orthogonally attach the first railing 125 to the second railing 130 and that the scope of the present invention is not intended to be limited to any particular exemplary embodiment herein described. Once the attachment is made, the position 131 (FIG. 6) of the second railing 130 along the first railing 125 can be adjusted to accommodate the dimension of a particular type of tile.

Figure 10:
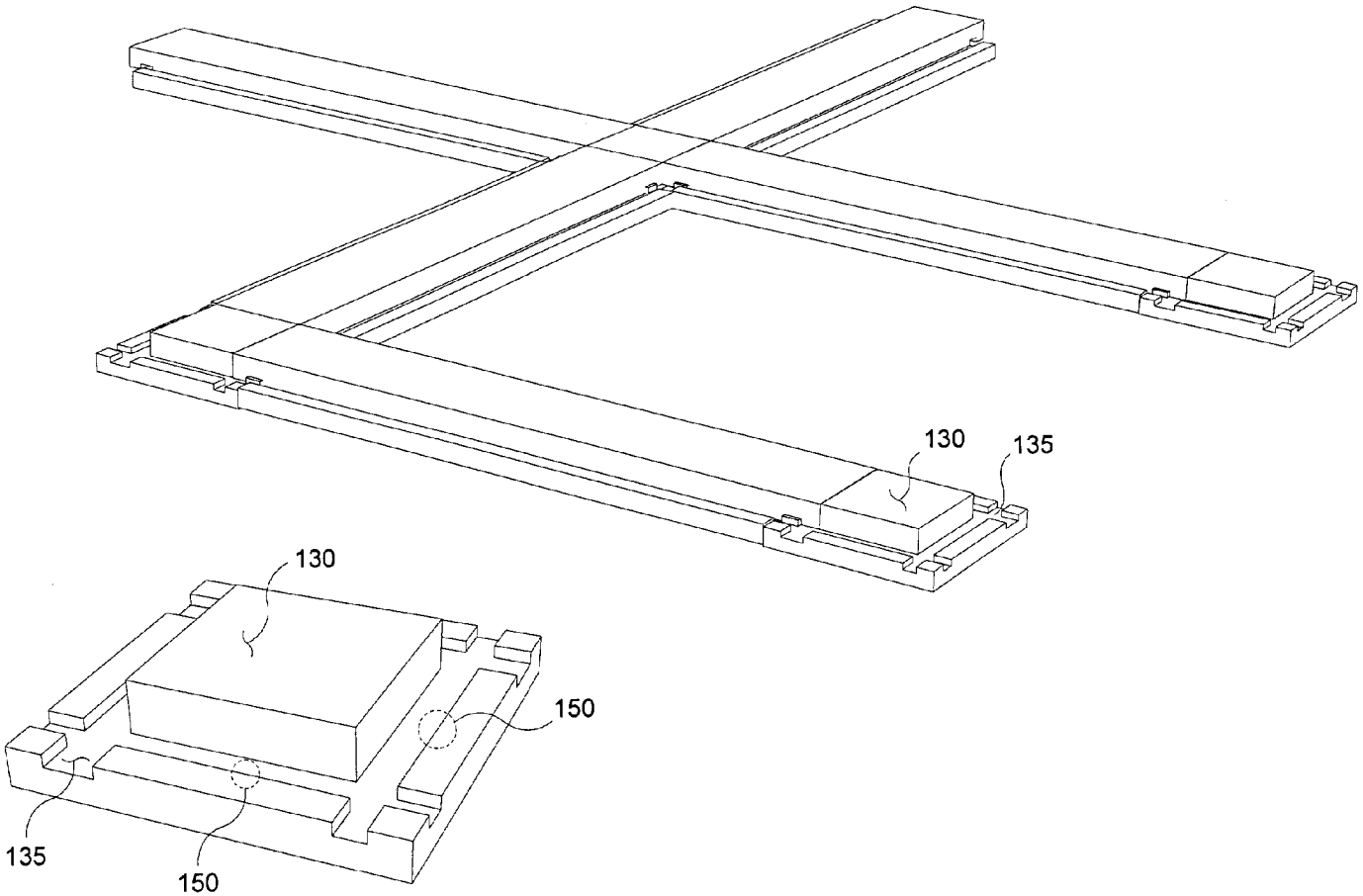
FIG. 10 is a pictorial diagram that depicts a rail tie that can be used to tie rails together according to the method of the present invention.

FIG. 10 is a pictorial diagram that depicts a rail tie that can be used to tie rails together according to the method of the present invention. According to one alternative embodiment of the invention, a tile installation rail tie comprises at least two railing connectors 150 and a border 130. Individual railings can be attached to the rail tie using the slide bushing 117 (FIG. 8) comprising one end of the railing. Hence, according to this embodiment, the railing connectors mimic a linear trackway 135 normally found as a colinear feature of a railing, i.e. tile installation fixture of the present invention.

Figure 11:
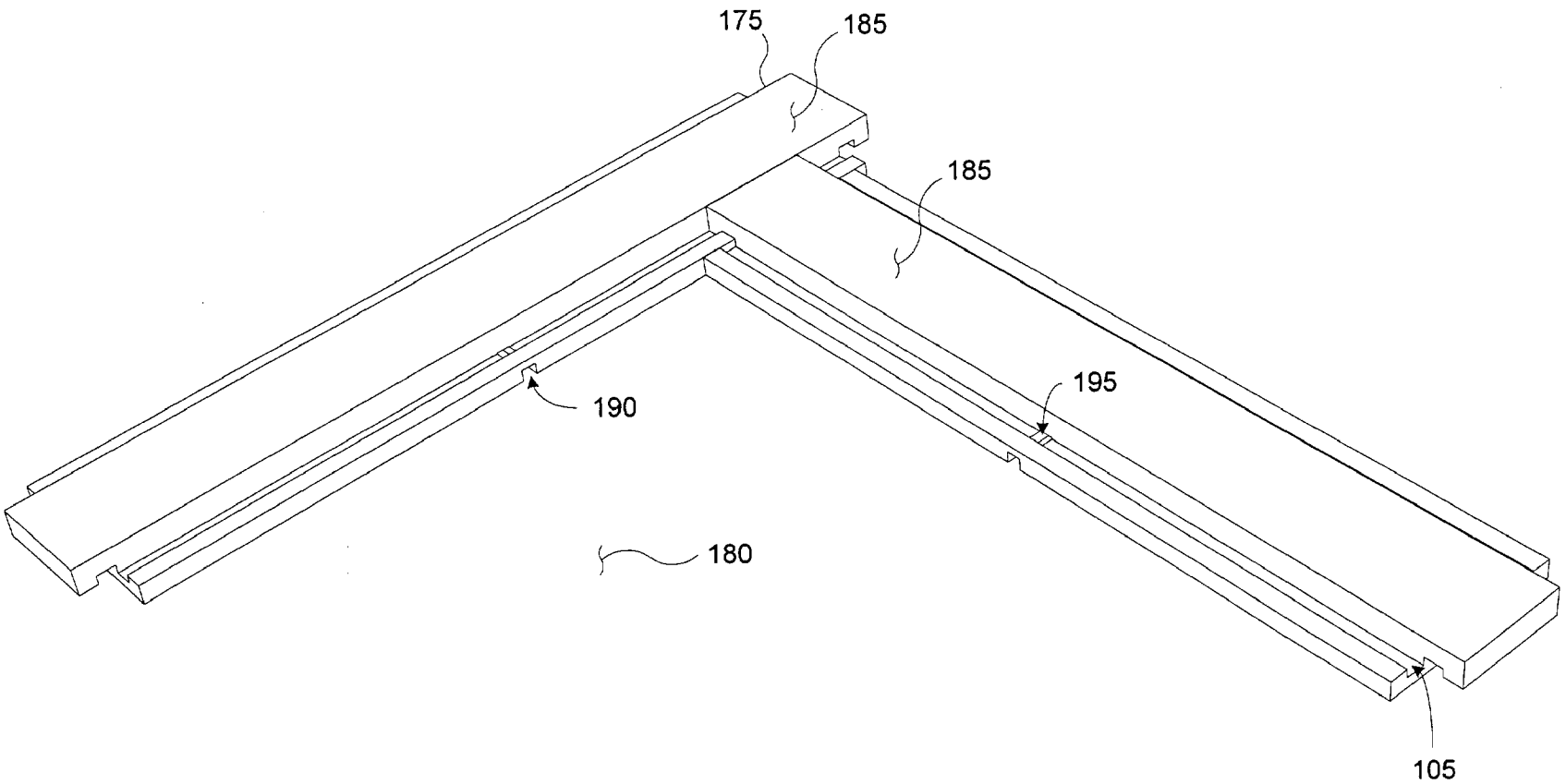
FIG. 11 is a pictorial diagram of a tile installation fixture comprising drainage and airflow paths according to the present invention.

FIG. 11 is a pictorial diagram of a tile installation fixture comprising drainage and airflow paths according to the present invention. According to one illustrative embodiment, a railing 185 comprises an airflow path 190. This may comprise a slot cut into the lower surface of the railing 185 orthogonal to the linear support comprising the railing. According to one alternative embodiment of a tile installation railing, a drainage orifice 195 is included in the invention. Such an orifice provides for the drainage of moisture from the support surface of the railing. In one exemplary embodiment, the drainage orifice 195 is disposed in a linear attachment trackway 105 embodied as a notch in a linear support surface. Hence, moisture accumulations in said trackway are drained downward towards the base (i.e. lower surface) of the railing and onto substrate 180 (FIG. 11).

In all of the embodiments henceforth described, tile installation fixtures (i.e. railings) may be fabricated from any suitable material. For example wood or plastic may be used to fabricate the tile installation fixtures. Selection of proper material relies on the ability of the material to hold a form while supporting normal tile floor loading. This typically requires that the material exhibit a high strength when subject to compression loading.

ALTERNATIVE EMBODIMENTS

While this invention has been described in terms of several preferred embodiments, it is contemplated that alternatives, modifications, permutations, and equivalents thereof will become apparent to those skilled in the art upon a reading of the specification and study of the drawings. It is therefore intended that the true spirit and scope of the present invention include all such alternatives, modifications, permutations, and equivalents.

What is claimed is:

1. A tile installation system, comprising:

a plurality of linear trackways;

a plurality of rail ties;

a plurality of railings interconnected via said linear trackways and said rail ties;

a lattice of tile receptacles formed by said interconnected railings;

at least one drainage orifice formed in at least one of said linear trackways; and at least one airflow slot cut in at least one of said railings away from said at least one drainage orifice, said at least one drainage orifice being disposed at a higher elevation than said at least one airflow slot.

2. The tile installation system of claim 1, wherein each of said rail ties includes at least two railing connectors and a border member.

3. A tile installation system, comprising:

a plurality of linear trackways;

a plurality of railings interconnected via said linear trackways;

a lattice of tile receptacles formed by said interconnected railings;

at least one drainage orifice formed in at least one of said linear trackways; and at least one airflow pathway formed in at least one of said railings away from said at least one drainage orifice, said at least one drainage orifice being disposed at a higher elevation than said at least one airflow pathway.

4. The tile installation system of claim 3, wherein said railings are interconnected in a substantially herringbone pattern.

5. The tile installation system of claim 3, wherein at least one of said railings is orthogonally attached substantially mid-span to an adjoining railing.

6. The tile installation system of claim 5, wherein each of said orthogonally attached railings includes integral border and tile support members.

7. The tile installation system of claim 6, wherein said tile support member is disposed at a lower elevation than said border member.

8. The tile installation system of claim 7, wherein the difference in elevation is substantially set to the thickness of a tile being used in installation.

9. The tile installation system of claim 8, wherein the top surface of the tile is substantially flush with the top surface of said border member.

10. The tile installation system of claim 5, wherein said orthogonally attached railings are adapted for installation onto a substrate.

11. The tile installation system of claim 6, wherein each of said linear trackways is disposed colinearly with said border member.

12. The tile installation system of claim 6, wherein each of said linear trackways is formed as an elongated recess in said tile support member.

13. The tile installation system of claim 6, wherein each of said linear trackways is recessed into the top surface of said tile support member.

14. The tile installation system of claim 5, wherein each of said orthogonally attached railings includes at least one slide bushing.

15. The tile installation system of claim 14, wherein said slide bushings are used in orthogonal attachment of said railings.

16. The tile installation system of claim 15, wherein each of said slide bushings includes a protruding finger and an adjoining carrier slot at one end thereof.

17. The tile installation system of claim 16, wherein said finger protrudes away from the top surface of said border member.

18. The tile installation system of claim 16, wherein said carrier slot is disposed between said protruding finger and the remaining body of said border member.

19. The tile installation system of claim 16, wherein said protruding finger and said adjoining carrier slot are sized according to the dimensions of a corresponding linear trackway.

20. The tile installation system of claim 16, wherein said carrier slot is formed by a notch in the bottom surface of said border member.

21. The tile installation system of claim 16, wherein said protruding finger and carrier slot of each railing are adapted to interlock with said linear trackway of an adjoining orthogonally disposed railing.

22. The tile installation system of claim 21, wherein said interlocked finger is adapted to slide within said linear trackway of said adjoining orthogonally disposed railing to accommodate the dimensions of a tile being used in installation.

23. A tile installation fixture, comprising:

a linear support having top and bottom surfaces;

a border having top and bottom surfaces, wherein said border is colinear with said linear support;

a linear attachment trackway being colinear with said linear support, wherein said linear attachment trackway comprises a notch set colinearly into the top surface of said linear support; and an orifice leading from the top surface to the bottom surface of said linear support.

* * * * *